US006935349B2

(12) United States Patent
Nicot et al.

(10) Patent No.: US 6,935,349 B2
(45) Date of Patent: Aug. 30, 2005

(54) WIG ADJUSTABLE TO THE SHAPE OF THE USER'S HEAD AND METHOD FOR CARRYING OUT SAID ADJUSTMENT

(75) Inventors: Jerome Nicot, Quimper (FR); Nicole Denelle, Boulogne Billancourt (FR)

(73) Assignee: NJ Diffusion SarL, Paris (FR)

( * ) Notice: Subject to any disclaimer, the term of this patent is extended or adjusted under 35 U.S.C. 154(b) by 96 days.

(21) Appl. No.: 10/239,728

(22) PCT Filed: Apr. 17, 2001

(86) PCT No.: PCT/FR01/01176

§ 371 (c)(1),
(2), (4) Date: Nov. 13, 2002

(87) PCT Pub. No.: WO01/78538

PCT Pub. Date: Oct. 25, 2001

(65) Prior Publication Data

US 2003/0116170 A1 Jun. 26, 2003

(30) Foreign Application Priority Data

Apr. 17, 2000 (FR) ..... 00 04937

(51) Int. Cl.[7] ..... A41G 3/00
(52) U.S. Cl. ..... 132/53
(58) Field of Search ..... 132/53, 201, 54–56

(56) References Cited

U.S. PATENT DOCUMENTS

| | | | | |
|---|---|---|---|---|
| 3,884,248 | A | 5/1975 | Mendelsen et al. | |
| 4,016,888 | A | 4/1977 | Smiley | |
| 4,658,841 | A | 4/1987 | Won | |
| 6,105,584 | A | 8/2000 | Williams | |
| 6,220,249 | B1 * | 4/2001 | Park | 132/53 |
| 6,257,244 | B1 | 7/2001 | Williams | |
| 2001/0013351 | A1 * | 8/2001 | Tang | 132/53 |

FOREIGN PATENT DOCUMENTS

| | | |
|---|---|---|
| FR | 2 123 211 | 9/1972 |
| GB | 1 388 300 | 3/1975 |

* cited by examiner

*Primary Examiner*—John J. Wilson
*Assistant Examiner*—Robyn Doan
(74) *Attorney, Agent, or Firm*—Harrison & Egbert

(57) ABSTRACT

A wig adjustable to the size and shape of the user's head includes an inner support or cap designed to cover the user's scalp and whereon is fixed natural or artificial hair. The invention is characterized in the cap is provided, inside, in the entire surface or in at least part of the surface defined by its periphery, a pleating mechanism for producing small pleats thereby reshaping the outline of the cap to make it fit the shape of the user's skull.

8 Claims, 5 Drawing Sheets

WIG ADJUSTABLE TO THE SHAPE OF THE USER'S HEAD AND METHOD FOR CARRYING OUT SAID ADJUSTMENT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention involves a wig or hairpiece that can be adjusted to the shape of the user's skull or head. It also is intended for a process that enables this adjustment.

BACKGROUND OF THE INVENTION

The wigs or hairpieces comprise an internal support or cap shaped in order to cover the user's scalp and on which natural or artificial hair is affixed, where this internal support is equipped with mechanisms or constructed in order to allow the attachment of the wig onto the user's head.

The internal support or cap is generally comprised of different parts identified by the areas of the head that they are intended to cover, such as, for example:

a top piece designed to cover an area of the skull that goes from the frontal bone to the middle point;

a left side and a right side (including brackets)

a rear piece; and a part designed to cover the nape of the neck.

The wigs can be made according to different known processes. For example:

A) A process referred to as the "machine" process, according to which the bands or wefts of hair (hair sewn together by a braid made by the machine) are sewn together on cotton or elastic ribbons, mainly for the nape of the neck and the sides; the bands or the wefts can also be sewn together partially or totally onto a lightweight fabric made of a network of stitches such as tulle, notably for the top piece.

B) A process referred to as the "hand" process, according to which the hair is tied separately or in groups of two to four on a tulle or light fabric having similar stitches.

C) A process referred to as the "monofilament" process, according to which the hair is tied on a base of translucent material, in a manner so as to imitate the natural implantation of a scalp.

It is understood that regardless of the manufacturing process, the internal support or cap of the wig must have a shape and dimensions that enable it to closely fit, as best possible, the shape of the skull of the person who must wear it.

In order to meet the above requirement, the wigs are mainly manufactured according to a standard size corresponding to the average in the market for these articles.

The contour of their cap is equipped with adjustable brackets that enable an adjustment on the order of +/−2 cm of this contour, which is of course, insufficient to cover all of the shapes of the head. A same wig model is then most often made in three different sizes for each one of the proposed colors, in order to best meet the demand, which does not solve, in a very satisfying manner, the problem posed by the particular shape of the each individual's skull, and has, in addition, the disadvantage of creating storage/stocking problems, and unfavorably affecting the cost of the articles.

The adjustable brackets are installed in the area of the nape of the neck of the cap of the wigs in order to reduce the contour of the wig. However, if these caps make it possible to obtain a reduction of the external circumference of the wig, only the base of the area of the nape of the neck is "correctable" and this correction can alter the curve of the wig (from temple to temple and/or from front to back).

It is possible, of course, to make, according to the different processes mentioned above, custom-tailored wigs (U.S. Pat. No. 5,133,370 A), but, in this case, the cost price of these articles is extremely high and the time necessary to make them is very long, of course.

In the document U.S. Pat. No. 4,016,888A, a solution has been proposed for solving the problem of the reduction of the size of a wig from the standard model in order to give it the characteristics of a small or an extra-small size, by a contraction of the cap on which the hair is implanted, a contraction obtained using three brackets for flexible attachment equipped with a connecting element that is able to be attached to one or the other of two complementary spaced out and fixed connection elements. These contraction mechanisms are affixed to the inside of the cap, in the median part of it, and they are placed in parallel along the contour lines going from the nape of the neck to the frontal area.

If it can be acknowledged that the process described in the above document makes it possible to reduce the size of a standard wig model, this method does not allow an adjustment of this wig to the user's head, the shape of which does not correspond to that of the "standard" head for which the wig has been made. In fact, the adjustment that such a system can allow only involves the contour of the front nape of the neck, which is not sufficient for allowing a satisfactory adjustment in the majority of the varied shapes of the head.

In addition, the contraction obtained by the device described in this document, between two attachment points, leads to the formation of a outside bulge going from one temple to the other, this unaesthetic bulge being more or less pronounced in going from the standard size to the small size to the extra-small size.

An object of the invention is to correct these disadvantages.

BRIEF SUMMARY OF THE INVENTION

According to the invention, this purpose is achieved using an adjustable wig having a cap that is equipped, on the inside, in at least one part of the surface defined by its circumference or outside contour, with gathering mechanisms to create small gathered areas and to then remodel the curve of the cap in order to adjust to the shape of the skull of the person using it.

The gathering mechanisms of the internal support or cap can be arranged and distributed in the entire surface of it, or in only certain areas of this surface such as, for example, the areas designed to cover the occipital and temporal regions of the scalp.

According to another characteristic arrangement applicable to the wigs made according to the process referred to as the "machine" process, the gathering mechanisms comprise a plurality of complementary adjustment mechanisms making it possible to adjust the distances between different points of the structure of the cap and oriented according to the inner contour of the cap (for example: the inner contour of the front nape of the neck and the inner contour right ear to left ear).

According to another characteristic arrangement applicable to wigs having a cap that is comprised at least in part, of a light fabric having a stitch such as a tulle or other, the gathering mechanisms comprise a plurality of soft gathering threads, preferably having an elastic nature, affixed at different points of the cap and threaded or "basted", having an ability to slide in the stitches of the fabric and in one or more directions, in a manner so that each of them can be tied or otherwise affixed by at least one of its ends, at a point more or less distant from its point of permanent attachment.

The wig according to the invention has notably the advantages:

- of enabling a very good adjustability to the curve of the skull of the person, due to the fact that it allows multiple adjustments of the cap for the different external and internal contours (multi-axes: temple to temple, front to nape of the neck, etc.) without resorting to any device or cutting or sewing operation on the cap; this excellent adjustability to the curve of the head being obtained without residual fluttering or degradation of the hair styling.
- of providing better comfort for the wearer;
- of ensuring a best esthetic representation of the alternative hairstyle; and
- of proposing to customers a single and unique cap size for almost all of the markets, which makes it possible to create significant management savings, while covering a very large market.

BRIEF DESCRIPTION OF THE SEVERAL VIEWS OF THE DRAWINGS

The goals, characteristics, and advantages above, and still others, emerge best from the description that follows and the attached drawings.

DETAILED DESCRIPTION OF THE INVENTION

Figure 1:
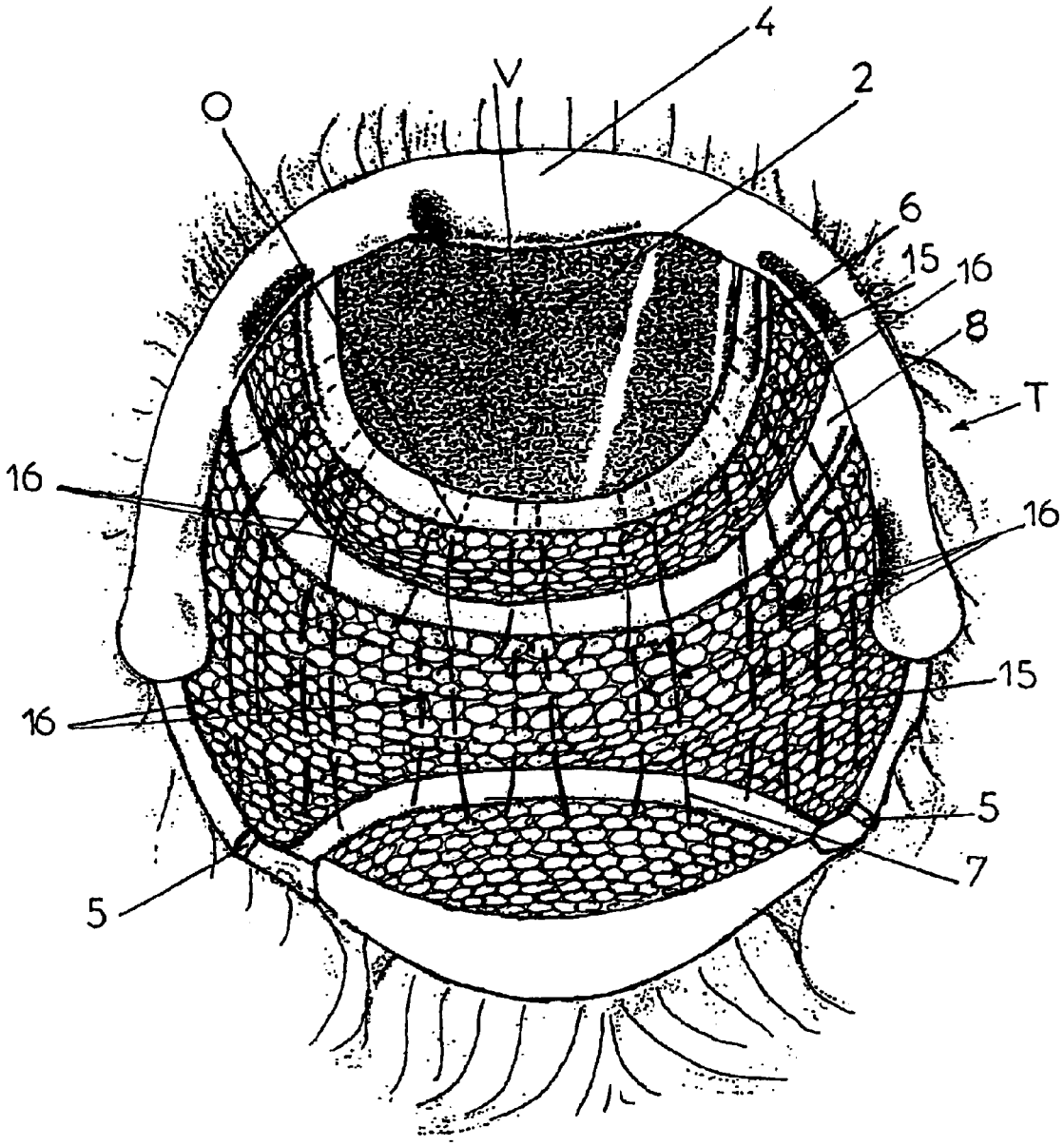
FIG. 1 is a front view of a wig that has been turned inside out showing an embodiment example of the invention.
Figure 2:
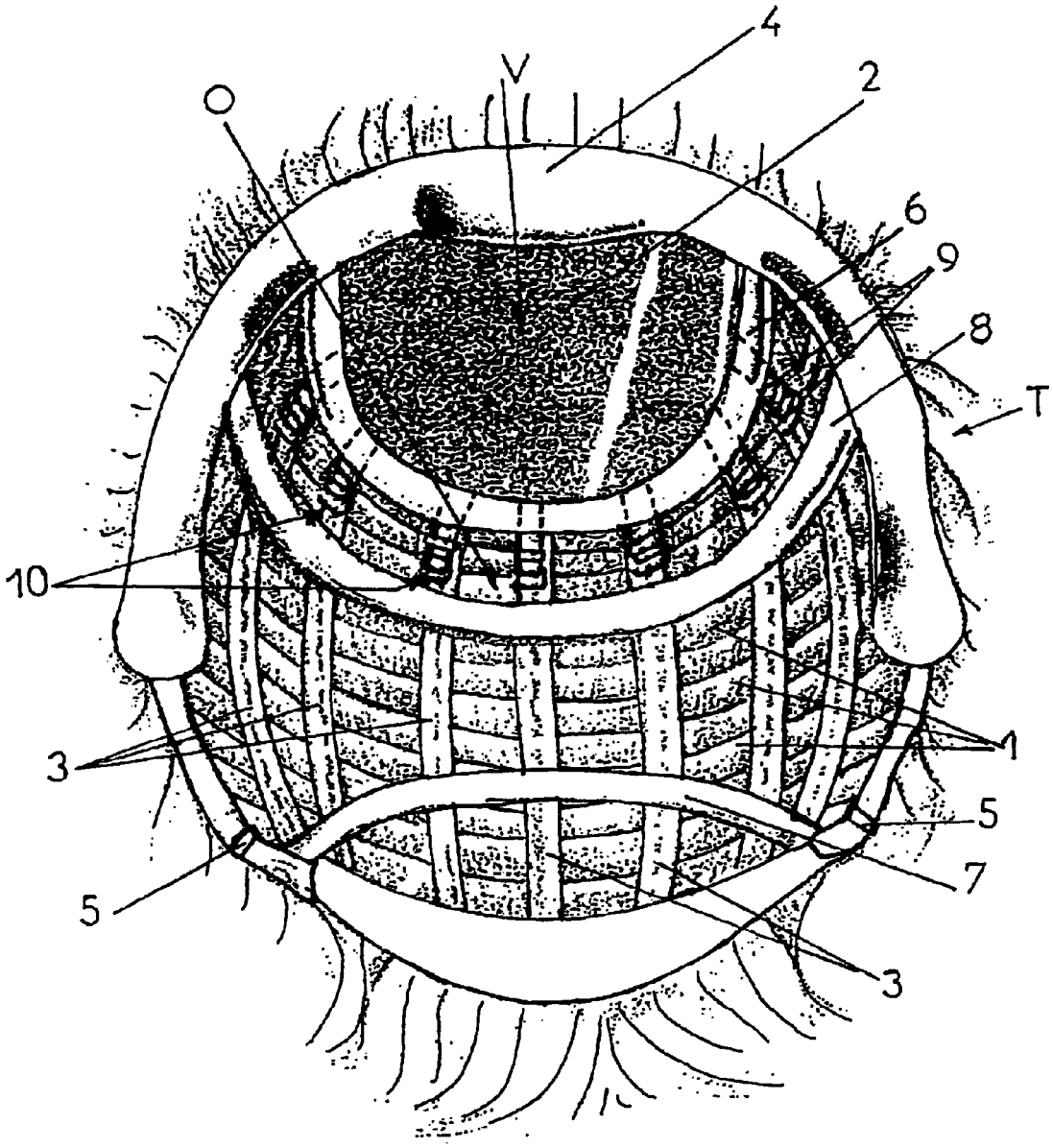
FIG. 2 is a front view similar to FIG. 1 and showing another embodiment example of the invention.
Figure 3:
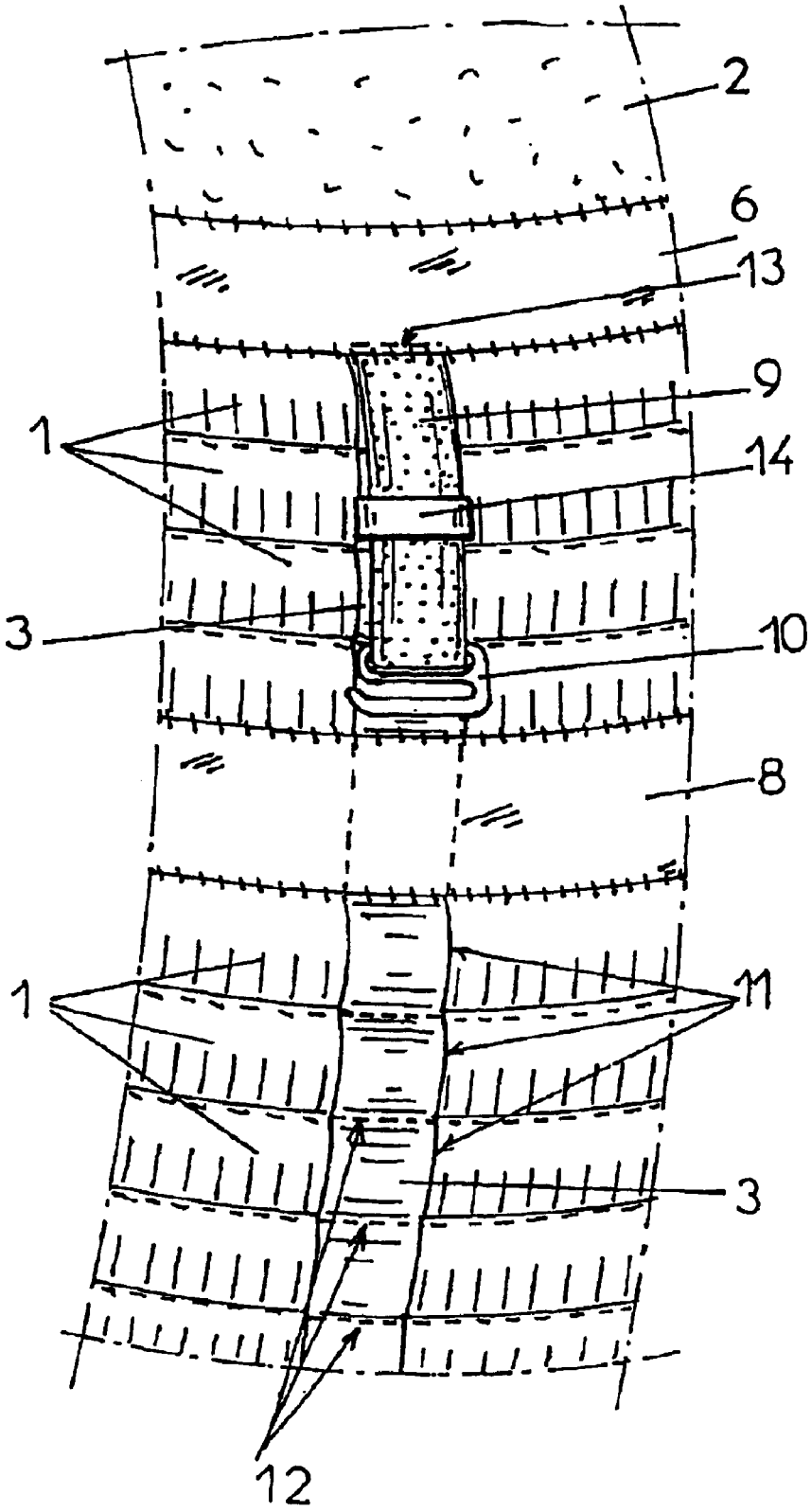
FIG. 3 is a detail view, on a large scale, showing an embodiment example of the adjusting mechanisms that equip the inner side of the cap of the wig, according to the embodiment mode of FIG. 2.

Reference is made to the drawings in order to describe the embodiment examples that are of interest, but in no way restrictive, of wigs containing the application of the invention.

According to FIGS. 2 to 6, the wig accepted as an example to show a first embodiment example of the invention is of the type obtained by the "machine" process, according to which the bands or wefts of hair 1, itself made in a known way using natural or artificial hair, are affixed by sewing onto the elements constituting the structure of the cap, which comprise, according to the example shown, a part comprised of a tulle 2 or other light fabric designed to cover the region of the vertex, the spaced-out ribbons 3 extending from the edge of the part 2 in the direction of the occipital and temporal regions, and a circumferential band 4 equipped with mechanisms for adjustment 5 allowing the adaptation to the contour of the head. The ribbons 3 can be made of an fabric that is non-stretch (cotton, for example) or elastic.

In an advantageous manner, the circumferential band 4 can be comprised of a piece of stretchable, non-slip fabric of the type described in the document WO 99/44452.A. In this case, other bands of fabric of this type are preferably equally incorporated in the structure of the cap, for example, around the area of the vertex V (band 6), around the area designed to cover the nape of the neck (band 7), a third band 8 can also be placed around the band 6 and at a distance from it.

It is recalled that this stretchable, non-slip fabric is noteworthy in that it is impregnated with an adhesive substance forming a thin layer that can be stretched out on at least its side intended to come into contact with the skin of the skull of a user, this stretchable layer having a non-slip, non-stick, or non-adhesive surface at temperatures less than its melting temperature, for example at ambient temperature, after impregnation of the fabric and drying.

According to a first characteristic arrangement of the invention, the cap of the wig is equipped, on the inside, in at least one area of the surface delimited by the circumferential band 4, or over this entire surface, with gathering mechanisms of this area, these gathering mechanisms making it possible to remodel the curve of this cap in order to adjust it closely to the shape of the skull of the person using it.

For example, the cap is equipped with gathering mechanisms in one or more of the following areas:

| | |
|---|---|
| Front/peak-top | |
| Peak-top/vertex | |
| Vertex/nape of the neck | |
| Temple to temple<br>Side-to-side | + depth |

The gathering mechanisms are, preferably, arranged and distributed in the areas of the surface inside the surface intended to cover the occipital regions O and temporal regions T of the skull.

The gathering mechanisms can be made up of a plurality of complementary devices for adjustment, making it possible to modify the distance between different points of the structure of the cap, in a manner so as to remodel the curve of the cap.

According to the example shown in FIGS. 2 to 6, these complementary mechanisms for adjustment comprise a plurality of flexible brackets 9 affixed, by means of one of their ends, to the structure of the cap, and the other end of which is equipped with a point of attachment 10.

In an advantageous manner, these adjusting brackets can be comprised of a narrow band of non-slip stretchable fabric, such as the one described in the document WO 99/44452.

On the other hand, the structure of the cap has a plurality of complementary points or instruments for attachment 11 designed to act together with the attachments 10 of the flexible brackets 9.

According to the example shown, the points of attachment 10 are comprised of small, flat skin clips, while the points of attachment 11 are comprised of adhesions formed by the portions of the ribbons 3 included between the sewing points 12 ensuring the attachment of the bands or wefts of hair 1 to the ribbons 3.

The adjusting brackets 9 are, for example, affixed on the border 6 of the vertex area, from which they extend to the bottom, in the direction of the occipital and temporal regions.

The adjusting brackets 9–10 are, for example, affixed by sewing, to attachment sites 13 of the front end of the ribbons 3 of the structure of the cap on the band 6 that delimits the region of the vertex V in such a manner that, in one of their usage positions, they are placed against the front portion of the ribbons.

Figure 5:
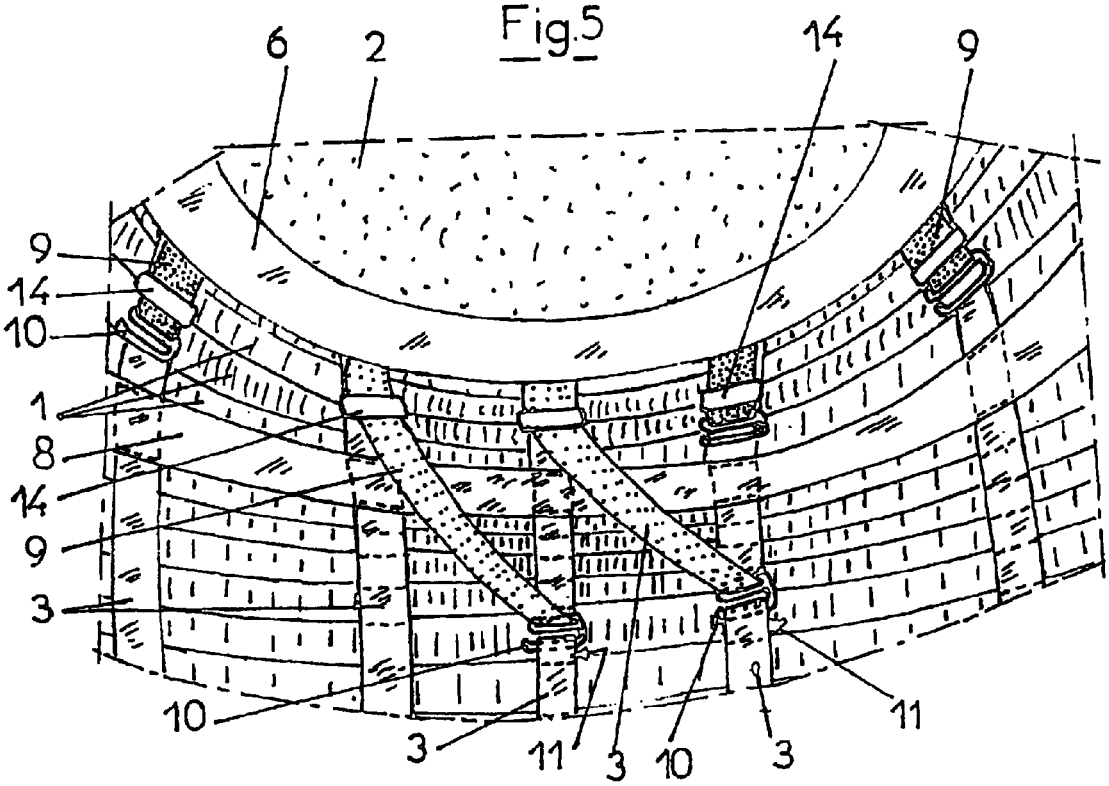
FIGS. 4 and 5 are detail views showing examples of the gathering up of the cap using the adjusting mechanisms, according to FIG. 2.
Figure 4:
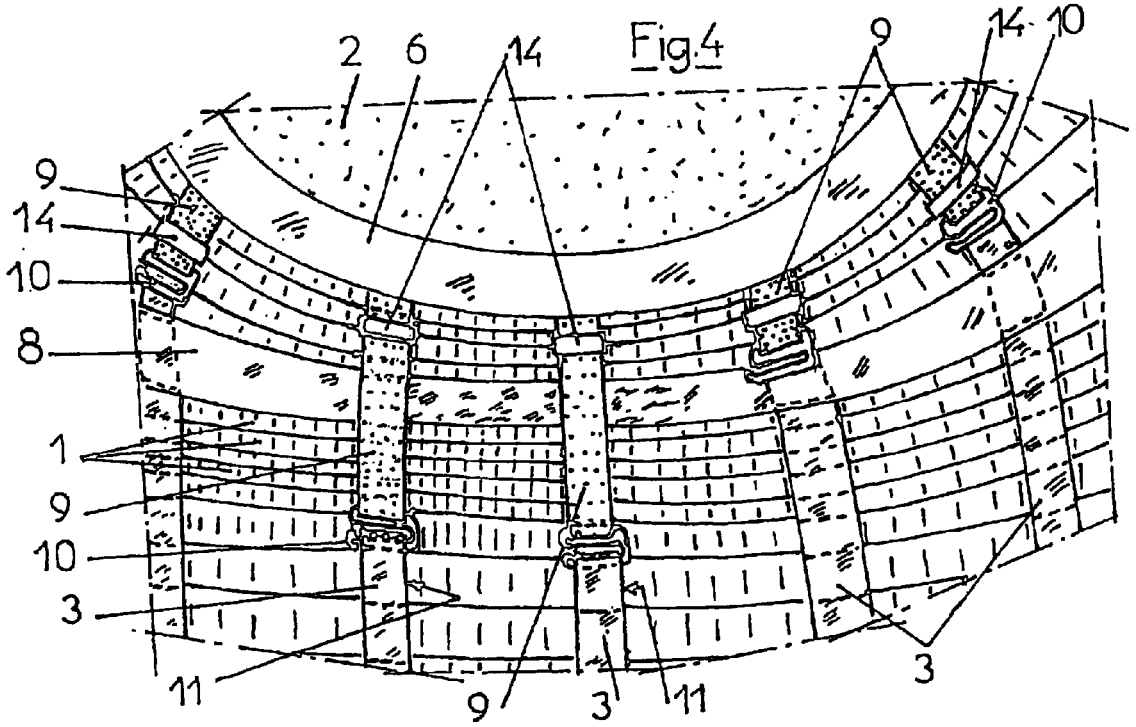
Figure 7:
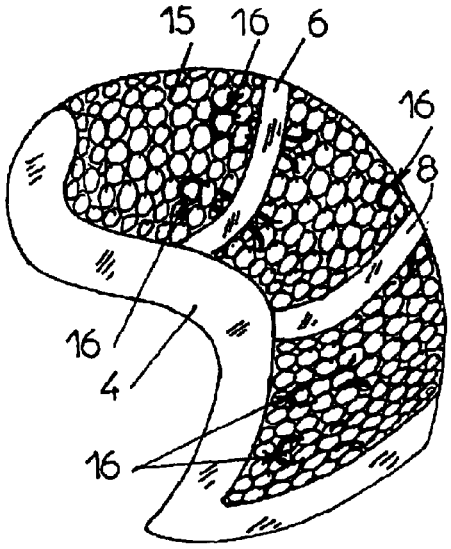
FIG. 7 is a perspective view, having a schematic character, of a cap or base of a wig equipped with adjusting mechanisms comprised of the gathering threads.
Figure 8:
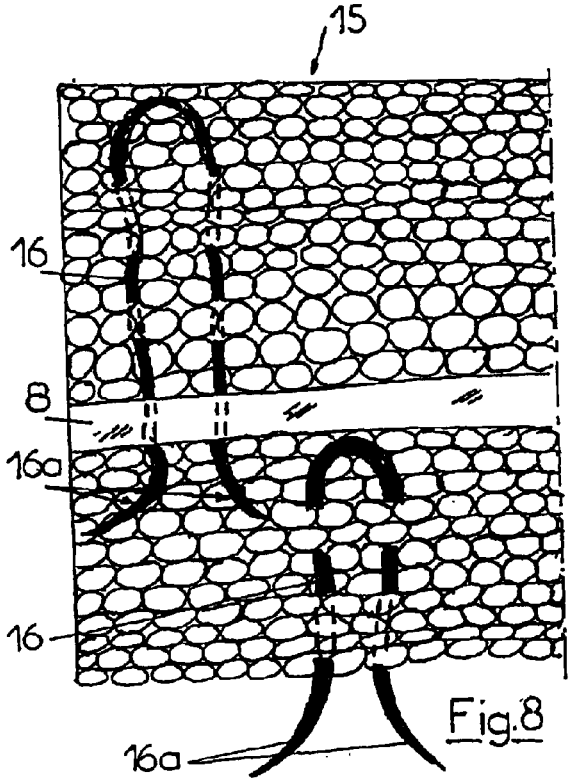
FIG. 8 is a detail view, on a large scale, showing the adjustment mode shown in FIG. 7.
Figure 9:
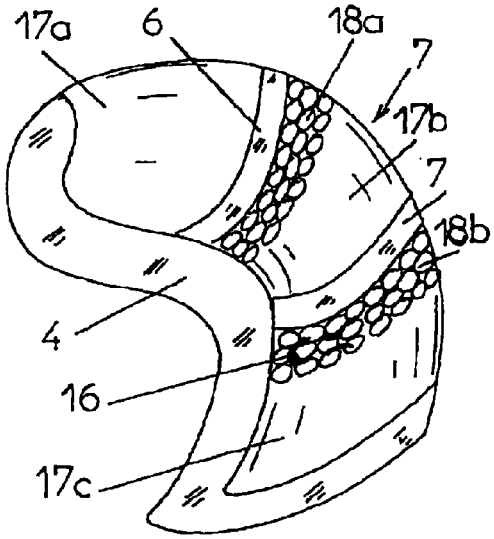
FIG. 9 is a perspective view, having a schematic character, showing another embodiment form of the invention applicable to wigs mounted according to the process referred to as the "monofilament" process.

It is understood that in putting the points of attachment 10 of the adjusting brackets 9 into the adhesions 11 located beyond the normal length of the adjusting brackets 9–10, a connection of the points of attachment of these adjusting brackets is ensured, causing a constricting of the hair wefts 1 between the attachment points 13 and 11 of the flexible brackets 9, i.e. a gathering of the structure of the cap; in this way, a modification of the curve of the cap is obtained (FIGS. 4 and 5).

This adjustment makes it possible to correct the defects of the inside and outside contours, in contracting the cap from the inside in the directions of the vertex-temple and vertex-nape of the neck, in parallel to the ribbons 3 of the structure of the cap.

However, a modification of the curve of the cap can also be obtained in the directions at an angle, or even perpendicular, to the ribbons. It is sufficient for this purpose to hook the adjusting brackets 9–10 on one of the adhesions 11 of the ribbons adjacent to the one against which they are affixed (FIG. 5).

For this purpose, loops 14 are affixed, for example, by sewing and in a floating manner, onto the ribbons 3, at a distance from the positions of attachment of the adjusting brackets 9–10. These brackets are engaged into these loops 14, which allow a curvature of these adjusting brackets and make it possible to obtain a contraction in a direction that is oblique, or even perpendicular, relative to the position of the ribbons 3.

Figure 6:
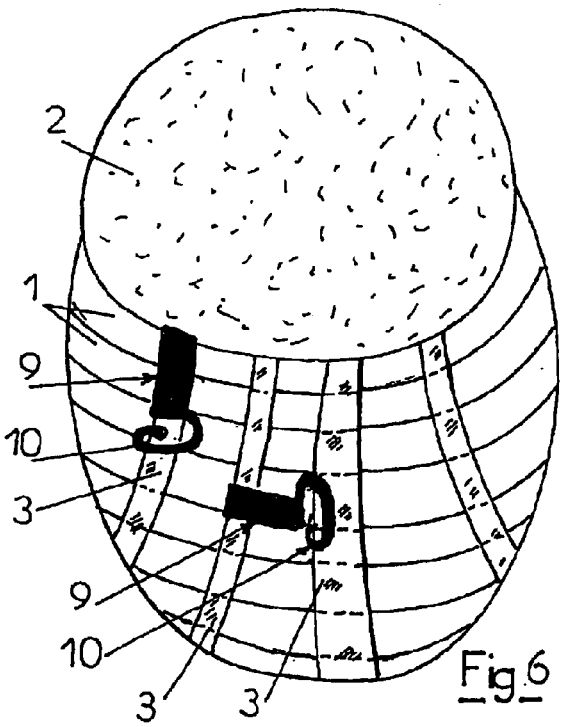
FIG. 6 is a perspective view, having a schematic character, of a cap or base of a wig, showing a variation of positioning of the adjusting brackets.

As shown in FIG. 6, one or more adjusting brackets 9–10 can also be affixed onto one or more ribbons 3 in order to allow a constricting of the cap in the horizontal direction.

It is possible, of course, in the frame of the invention, to replace the hooking mechanisms of the adjusting brackets described above, as an example of interest, with any adequate adjusting mechanisms for modifying the curve of the cap in the areas delimited by its contour such as buttons, snap fasteners, self-adhesive tapes, gatherings, elastic ribbons, clips, hooks, skin clips, attachment brackets, etc. Some of these mechanisms can be selected and used in an exclusive manner, or they can be used in combination.

According to another embodiment mode of the invention of particular interest, applicable to the wigs whose cap or base is comprised, at least in part, of a light fabric 15 having stitches such as a tulle or other, the gathering mechanisms comprise a plurality of flexible gathering threads 16, preferably having an elastic nature, affixed at different points of the cap and threaded or "basted", having an ability to slide into a plurality of stitches of the fabric and in different directions, for example depending on the site of their area of implantation. In a manner in order to obtain a gathering of the cap in one or more areas of it, it is sufficient to tie these gathering threads by at least one of their ends, at points more or less distant from its point of attachment.

The gathering threads 16 can be comprised of rubber "covered" threads.

According to the example shown in FIGS. 1 and 7 to 9, the gathering threads 16 are used in the form of small open curls for tightening which take the shape of an elongated U whose two parallel or approximately parallel strands have a free end 16*a*, and are threaded on, with an ability to slide into a plurality of stitches of the cap or base 15. In pulling on the free ends of these small curls for tightening, small gathers are obtained which contract the wig without forming unsightly bulges, the contraction being distributed in a harmonious manner on the entire gathered area.

Then, one can obtain small gathers and very precise contractions having the desired length. The closing of the small curls 16 can be obtained simply by tying their free ends 16*a*. Of course, the assembly of these ends can also be done using other connection mechanisms such as hooks or others.

The threads or small gathering curls 16 can be oriented in order to allow the adjustments in all directions, in a manner so as to permit a perfect adaptation of the wig to the contour of the head of the wearer.

This adjusting device (in addition to the previous one) can also be applied in an advantageous manner to the wigs that are set up "by machine". In this case, each gathering thread is affixed to the desired site on a braid or band of hair and it is arranged overlapping or interlacing a plurality of successive adjacent braids or bands, in a manner so as to be able to be attached by threading or otherwise, during the adjustment of the wig, to a braid or band of hair distant from the one to which it is initially affixed, the connection of the attachment points of the gathering thread making possible a constricting of the wefts of the hair between these attachment points.

When the gathering threads have the form of a small open curl, the two strands of it are arranged overlapping or interlacing with a plurality of hair bands, in a manner such that these free ends can be assembled by being tied or otherwise, so as to constitute a loop that is more or less large in size ensuring a more or less narrow connection of these braids. The tying of the two strands of gathering threads can be done on the inside or the outside of the wig; when the knot is made on the outside, it is completely masked by the hair.

The system for adjustment according to the invention is also applicable to the wigs mounted according to the process referred to as the "monofilament" process.

In this case, taking into account the fact that the base 17 is made of a material having a reduced flexibility, bands 18*a*, 18*b* of elastic tulle or other light stitched fabric, having a width of several centimeters (FIG. 9), are interposed between the portions of this base, for example, in the direction from temple to temple, making it possible to put into position the gathering mechanisms described above.

According to the invention, the definitive implementation of the wig is done, conveniently and rapidly, when it is purchased, on the head of the person for which it is intended.

The ties, gather loops or other gathering mechanisms which were not used in order to adjust the wig can be left or eliminated by a simple cut by scissors.

The invention also involves the adjusting process, to the side and the shape of the user's head, of the wigs whose cap or base is comprised, in part or in totality, of a light stitched fabric 15, 18*a*, 18*b* characterized in that positioned, at different points of the base or cap, are flexible gathering threads 16, preferably having an elastic nature, threaded or "basted", having an ability to slide in the stitches of the fabric and in one or more directions, and in that, during the adjustment of the wig, one pulls on the free end or on the two ends 16*a* of these gathering threads 16, in a manner so as to create a plurality of small gathers in the area traversed by them, and then one ties the free end or the free ends to the base or cap in the desired gathering or constricting position.

In an advantageous manner, the gathering threads 16 are positioned on the base or cap 15 in the shape of small open curls, in a manner so as to have two parallel or approximately parallel strands threaded or "basted" in the stitches of the base or cap, and in that the adjusting of the wig to the size and the desired shape is obtained by pulling on the two strands of the small open curls and by assembling, for example, by tying, the free ends 16*a* of the strands.

We claim:

1. A wig adjustable to a size and shape of a head of a user comprising:

a cap having a size suitable for fitting generally onto the head;

a plurality of hairs being affixed to said cap, said plurality of hairs being natural or artificial; and a gathering means formed on an interior of said cap along at least a portion of a circumference of said cap, said gathering means for making small gathers in different directions so as to adjust a curvature of said cap to conform to the shape of the head, said cap having a light stitched fabric in at least a portion thereof, said gathering means comprising a plurality of soft gathering threads affixed at different points respectively on said cap, said plurality of soft gathering threads respectively slidable in the stitches of said fabric and oriented along different contours within said cap, said plurality of soft gathering threads each having a small open curl shape with approximately parallel free ends, said free ends being connectable together by tying.

2. The wig of claim 1, said cap having a plurality of areas thereon, a first area of said plurality of areas being a front peak-top area, a second area of said plurality of areas being a peak-top vertex area, a third area of said plurality of areas being a vertex nape-of-the-neck area, a fourth area of said plurality of areas being a temple-to-temple area, a fifth area of said plurality of areas being a side-to-side area, said gathering means formed in at least one of said plurality of areas.

3. The wig of claim 1, said plurality of soft gathering threads being elastic threads.

4. The wig of claim 1, said cap comprising an adjustable flexible circumferential band having flexible internal contour bands, said flexible internal contour bands being comprised of a stretchable non-slip fabric impregnated with an adhesive, said adhesive forming a thin layer that is stretchable on at least a side suitable for contacting the head of the user.

5. A wig adjustable to a size and shape of a head of a user comprising:

a cap having a size suitable for fitting generally onto the head;

a plurality of hairs being affixed to said cap, said plurality of hairs being natural or artificial; and a gathering means formed on an interior of said cap along at least a portion of a circumference of said cap, said gathering means for making small gathers in different directions so as to adjust a curvature of said cap to conform to the shape of the head, said cap comprising bands of braided hair, said gathering means comprising a plurality of soft gathering threads affixed respectively to said bands, said plurality of soft gathering threads having a small open curl shape with two parallel strands arranged by overlapping or interlacing successive adjacent braids of said bands in a manner so as to having free ends that are tied together.

6. The wig of claim 5, said plurality of soft gathering threads being elastic threads.

7. A wig adjustable to a size and shape of a head of a user comprising:

a cap having a size suitable for fitting generally onto the head;

a plurality of hairs being affixed to said cap, said plurality of hairs being natural or artificial; and a gathering means formed on an interior of said cap along at least a portion of a circumference of said cap, said gathering means for making small gathers in different directions so as to adjust a curvature of said cap to conform to the shape of the head, said cap comprising space-out ribbons formed in at least a portion of said cap, said ribbons having bands of braided hair affixed by sewing thereto, said gathering means comprising a plurality of flexible brackets affixed at one end to said cap, an opposite end of each of said plurality of flexible brackets having an attachment means thereon, said gathering means further comprising a plurality of instruments, said attachment means for attachment to said instruments of said plurality of flexible brackets, said instruments being comprised of strands formed by portions of said ribbons, said plurality of flexible brackets being sewed to attachment sites at a front end respectively of said ribbons on a band formed around a portion of said cap, said ribbons having a fixed loop formed in a floating manner thereon at a distance from the attachment site, said plurality of attachment points respectively engageable with said fixed loops.

8. The wig of claim 7, said plurality of flexible brackets being formed of a stretchable fabric.

* * * * *